US008365916B2

(12) United States Patent
Gelardi

(10) Patent No.: US 8,365,916 B2
(45) Date of Patent: Feb. 5, 2013

(54) CONTAINERS AND PACKAGES WITH IMPROVED INTERIOR STRUCTURES

(75) Inventor: John A. Gelardi, Wake Forest, NC (US)

(73) Assignee: MeadWestvaco Corporation, Richmond, VA (US)

( * ) Notice: Subject to any disclaimer, the term of this patent is extended or adjusted under 35 U.S.C. 154(b) by 296 days.

(21) Appl. No.: 12/739,201

(22) PCT Filed: Oct. 30, 2008

(86) PCT No.: PCT/US2008/081753

§ 371 (c)(1),
(2), (4) Date: Apr. 22, 2010

(87) PCT Pub. No.: WO2009/058979

PCT Pub. Date: May 7, 2009

(65) Prior Publication Data

US 2010/0243509 A1 Sep. 30, 2010

Related U.S. Application Data

(60) Provisional application No. 60/984,230, filed on Oct. 31, 2007.

(51) Int. Cl.
*B65D 83/04* (2006.01)

(52) U.S. Cl. ..... 206/531; 206/1.5; 206/538

(58) Field of Classification Search ..... 206/528, 206/530, 531, 532, 533, 535, 536, 538, 539, 206/1.5

See application file for complete search history.

(56) References Cited

U.S. PATENT DOCUMENTS

| | | | | |
|---|---|---|---|---|
| 7,347,325 | B2 * | 3/2008 | O'Neill et al. | 206/449 |
| 7,588,149 | B2 * | 9/2009 | Gelardi | 206/531 |
| 7,591,372 | B2 * | 9/2009 | Gelardi et al. | 206/538 |
| 7,806,270 | B2 * | 10/2010 | Seibert et al. | 206/531 |
| 2004/0256277 | A1 * | 12/2004 | Gedanke | 206/538 |
| 2005/0183981 | A1 * | 8/2005 | Gelardi | 206/531 |
| 2007/0023317 | A1 * | 2/2007 | Brozell et al. | 206/538 |
| 2007/0102318 | A1 * | 5/2007 | Gelardi et al. | 206/538 |
| 2007/0235368 | A1 | 10/2007 | Knutson | |
| 2008/0290109 | A1 * | 11/2008 | Williams | 221/154 |
| 2009/0045096 | A1 * | 2/2009 | Knutson et al. | 206/531 |

FOREIGN PATENT DOCUMENTS

| | | |
|---|---|---|
| WO | WO0202434 | 1/2002 |
| WO | WO2004037657 | 5/2004 |
| WO | WO2005030606 | 4/2005 |

* cited by examiner

*Primary Examiner* — Luan K Bui
(74) *Attorney, Agent, or Firm* — MWV Intellectual Property Group

(57) ABSTRACT

A storing and dispensing system (10) includes a first sliding element (12) and a sleeve (14). The first sliding element (12) has a base configured to hold at least one article, and the base incorporates a flange portion (71*a*). The sleeve (14) further includes a first side (16) or (18), an open end, and at least one guide rail (40). The first side (16, 18) is matingly connected to a second side (the other of 16, 18) to form a void for receiving the sliding element (12). The open end is configured to permit the sliding element (12) to translate between a first position and a second position. The at least one guide rail (40) includes a first retaining edge (42), positioned within the void, to cooperatively contact the flange 71*a*.

10 Claims, 13 Drawing Sheets

CONTAINERS AND PACKAGES WITH IMPROVED INTERIOR STRUCTURES

This application is a 371 of PCT/US08/81753 filed on Oct. 30, 2008 which claims benefit of 60/984,230 filed on Oct. 31, 2007.

FIELD OF THE DISCLOSURE

The present disclosure relates generally to a container that houses multiple sliding elements, such as a tray, for storing and dispensing articles. More specifically, embodiments of the present disclosure include those directed to containers and packages with sliding elements for holding articles, guide rails for separating and stacking multiple sliding elements, locking mechanisms, and releasing mechanisms.

BACKGROUND

Child-resistant or lockable containers, wherein multiple movements are required to open the container, have many uses. One use for a lockable container is to inhibit access to articles such as medicine and medicaments in the form of pills and tablets, which if consumed by an unintended person could be fatal. For example, locking caps on medicine bottles are well known. The typical locking cap mechanism requires a coordinated alignment and tipping, or axial pressure, or inward radial squeezing while turning the cap, to remove it from the bottle and in order to access the articles therein.

Alternatively, articles may be packaged in a primary container and the primary containers grouped and packaged in secondary container, such as a paperboard box. Examples of primary containers include chips, satchels, pouches, pillows, vials, blister packs, and the like. When a typical paperboard box holding one or more primary containers is opened, all of the articles are immediately available. Children who can open such secondary containers now may have access to a dangerous quantity of articles not intended for their consumption.

Against the present state of the art, the Applicant seeks to create a need and market for containers of greatly increased capacity that can store and orderly dispense articles. In addition, the Applicant seeks to create a need and market for containers with one or more slidable elements that hold articles, such as blister packs and trays, with child-resistant features that require coordinated motions in order to access the articles. Further, the Applicant seeks to create a need and market for a child-resistant secondary package that is inexpensive to manufacture and re-useable. Related to these desires, the Applicant seeks to create a need and market for alternative embodiments with less sophisticated child-resistance features.

DETAILED DESCRIPTION

As required, detailed embodiments of the present disclosure are disclosed herein. It must be understood that the described embodiments are merely exemplary of the disclosure that may be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials or methods have not been described in detail in order to avoid obscuring the present embodiments. Therefore, specific structural and functional details disclosed herein are not to be interpreted as limiting, but merely as a basis for the claims and as a representative basis for teaching one skilled in the art to variously employ the present disclosure.

It is contemplated that the present disclosure is not limited to the pharmaceutical and personal healthcare related articles referenced with the illustrated embodiments, but is applicable to any small, delicate, sensitive, or portable article. Examples of such articles include all manner of consumable products such as candy, food, vitamins, tobacco, and the like; all manner of personal care products such as contact lens, birth control devices, smoking cessation patches, hearing aid batteries, and the like; and any item that can fit within a portable container. Further, the present disclosure is not limited to the slidable blister pack referenced with the illustrated embodiments, but is applicable to any slidable element, card, rack, support, holder, shelf, drawer, vessel, and the like to which an article of any sort may be held, stored, attached, contained, secured or otherwise associated with the article.

Figure 8:
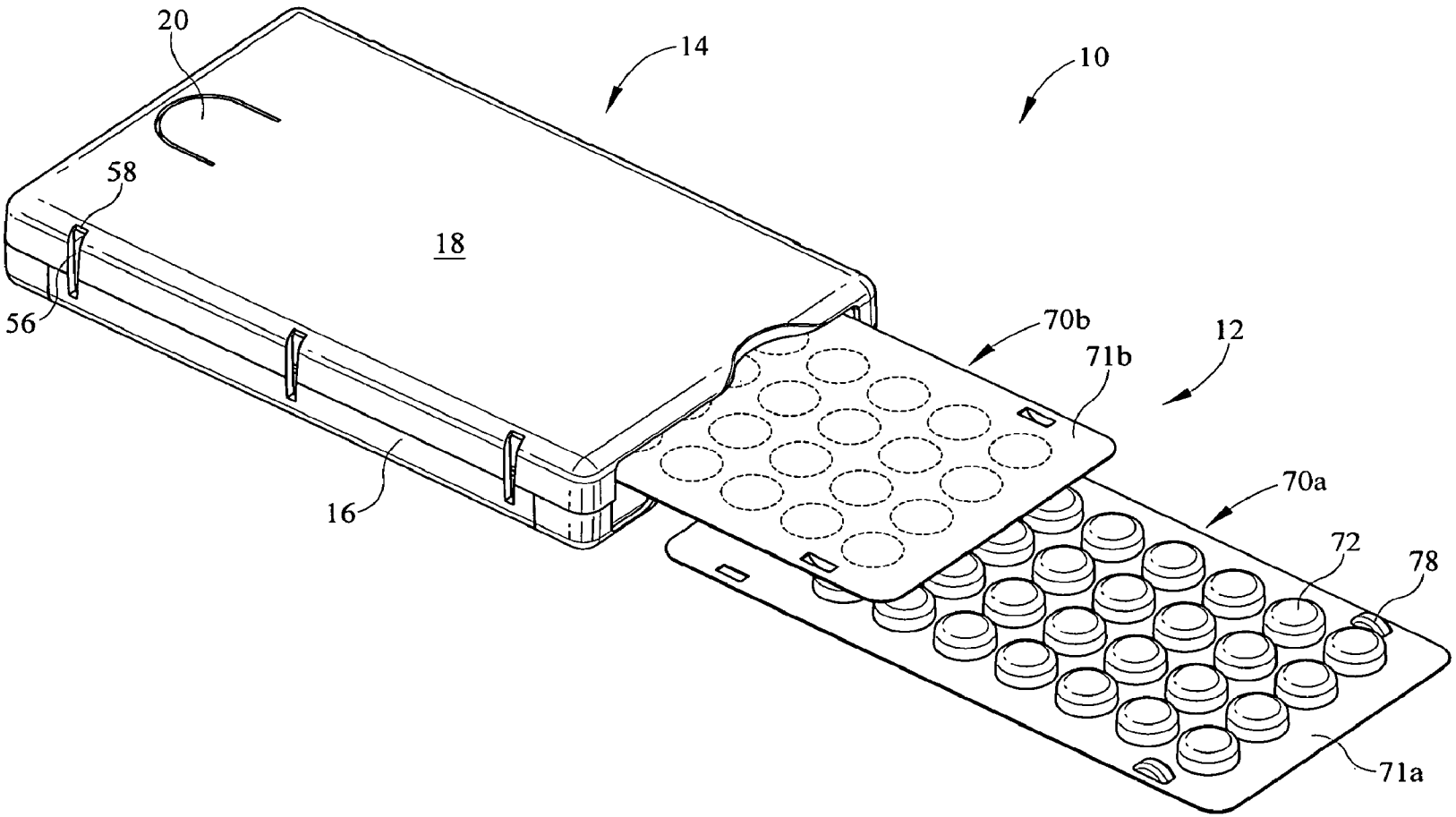

Referring now to the drawings, wherein like numerals represent like features throughout, there are illustrated embodiments of the present disclosure. Turning first, momentarily, to FIG. 8, there is shown an exemplary lockable package 10. As illustrated, the lockable package 10 holds stacked elements 12 within a lockable sleeve 14.

Figure 1:
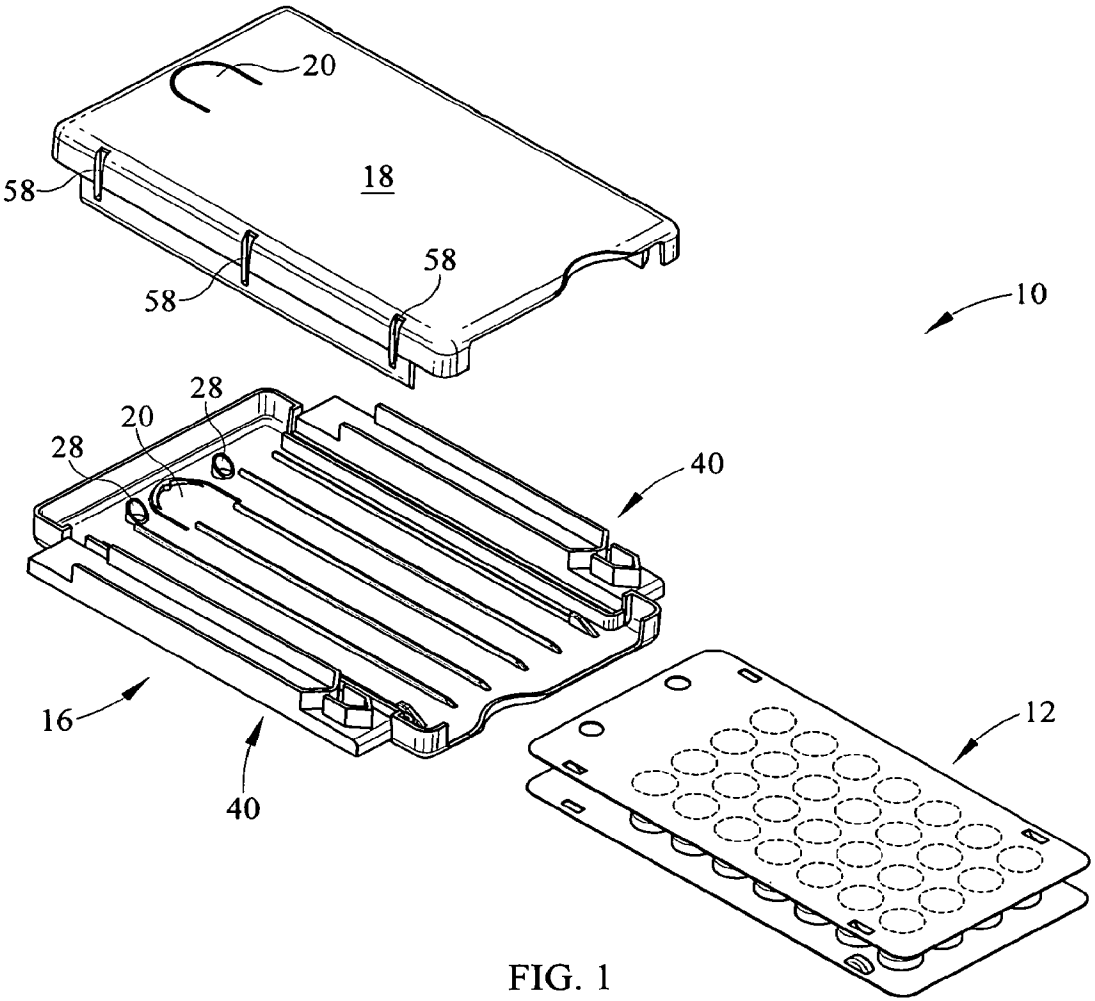
FIG. 1 is an exploded view of an exemplary lockable package, according to the present disclosure.
Figure 2:
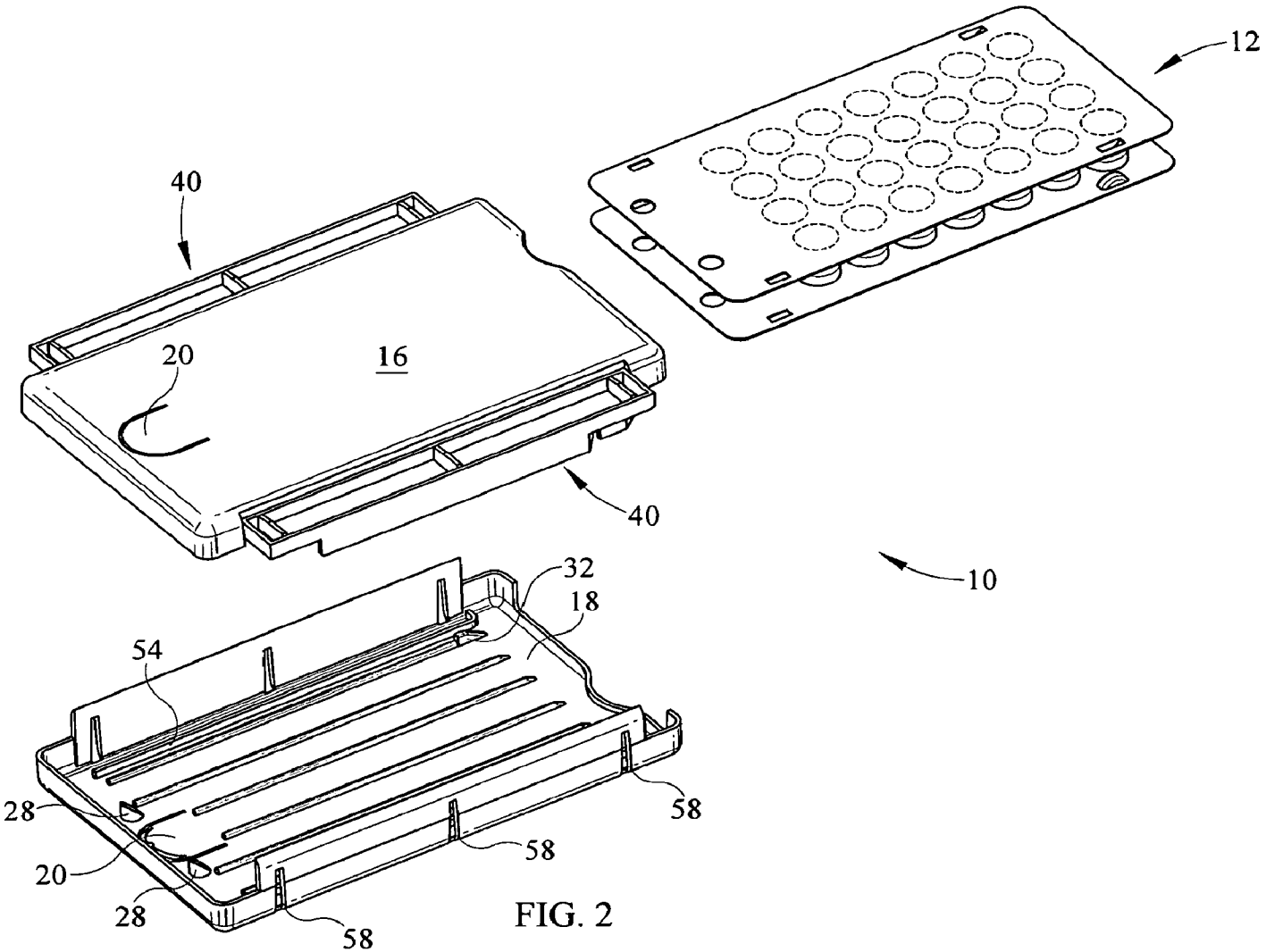
FIG. 2 is an alternative exploded view of the lockable package of FIG. 1.
Figure 3:
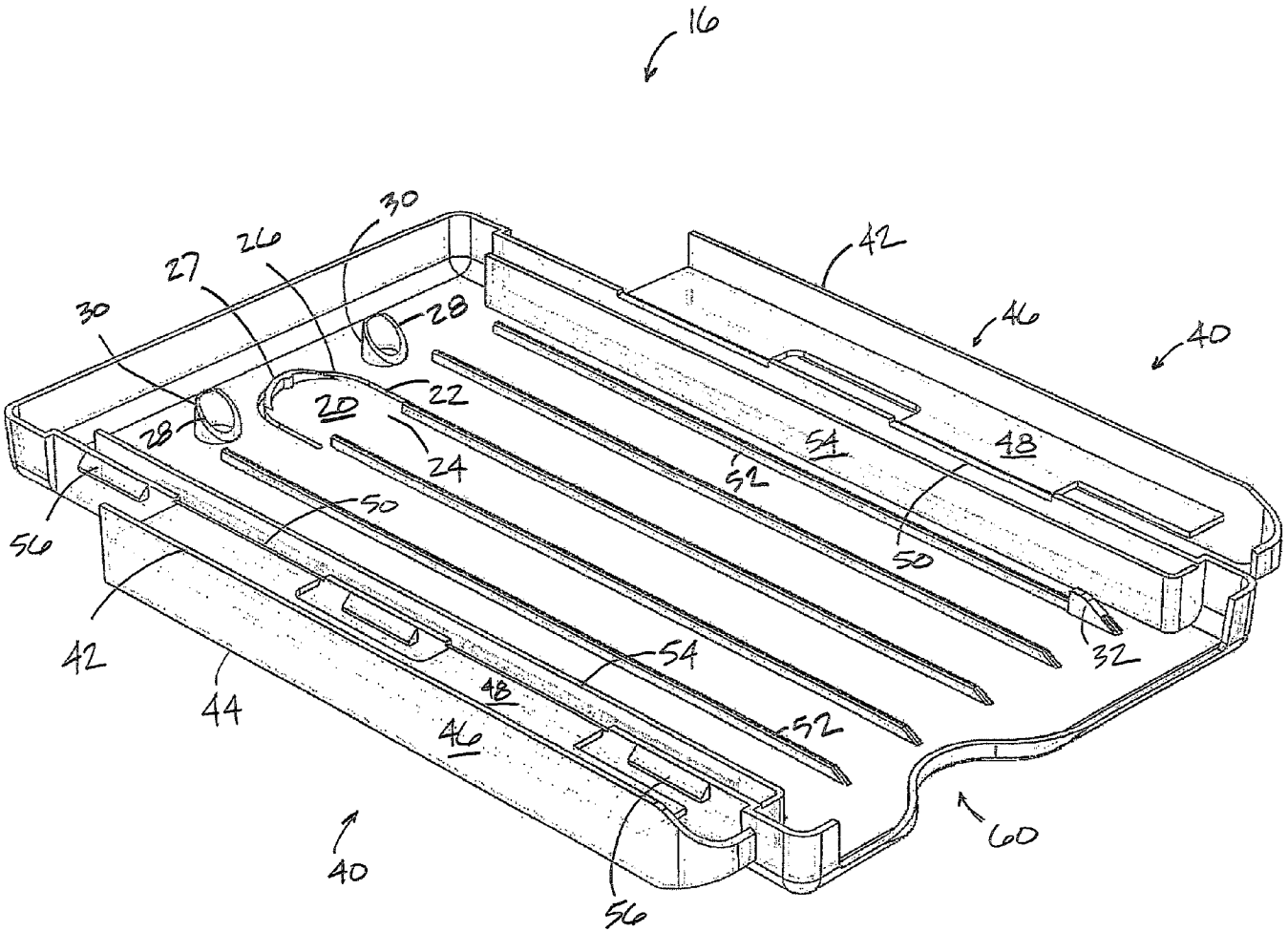
FIGS. 3-5 are perspective views of the sleeve base of the container of FIG. 1.

Turning now to FIGS. 1-3, the sleeve 14 comprises a base 16 and a top 18. The illustrated base 16 and top 18 each include a release button 20 defined by a release surround 22 and a hinge 24 that connects the release button 20 to the surrounding structure. Each of the illustrated release buttons 20 includes a free end 26 and each illustrated free end 26 includes a raised edge 27. Pushing inwardly on a release button 20 urges the free end 26 and associated raised edge 27 inwardly to disengage a locked sliding element 12, as explained below.

The illustrated base 16 and top 18 further include elements that form a locking mechanism: a plurality of locking posts 28, each with a respective engaging edge 30, are located proximate to the release button 20. In alternative embodiments one locking post 28 is provided, in other embodiments additional locking posts 28*x* are provided. Still, in other alternative embodiments only one of the base 16 or top 18 includes a locking mechanism. The base 16 and top 18 each further include optional stop ribs 32. The sleeve 14 includes an improved interior structure comprising guide rails 40, which perform various functions including separating and retaining the sliding elements 12, and guiding a sliding element 12 as it translates between positions within the void defined by assembled base 16 and top 18.

Figure 4:
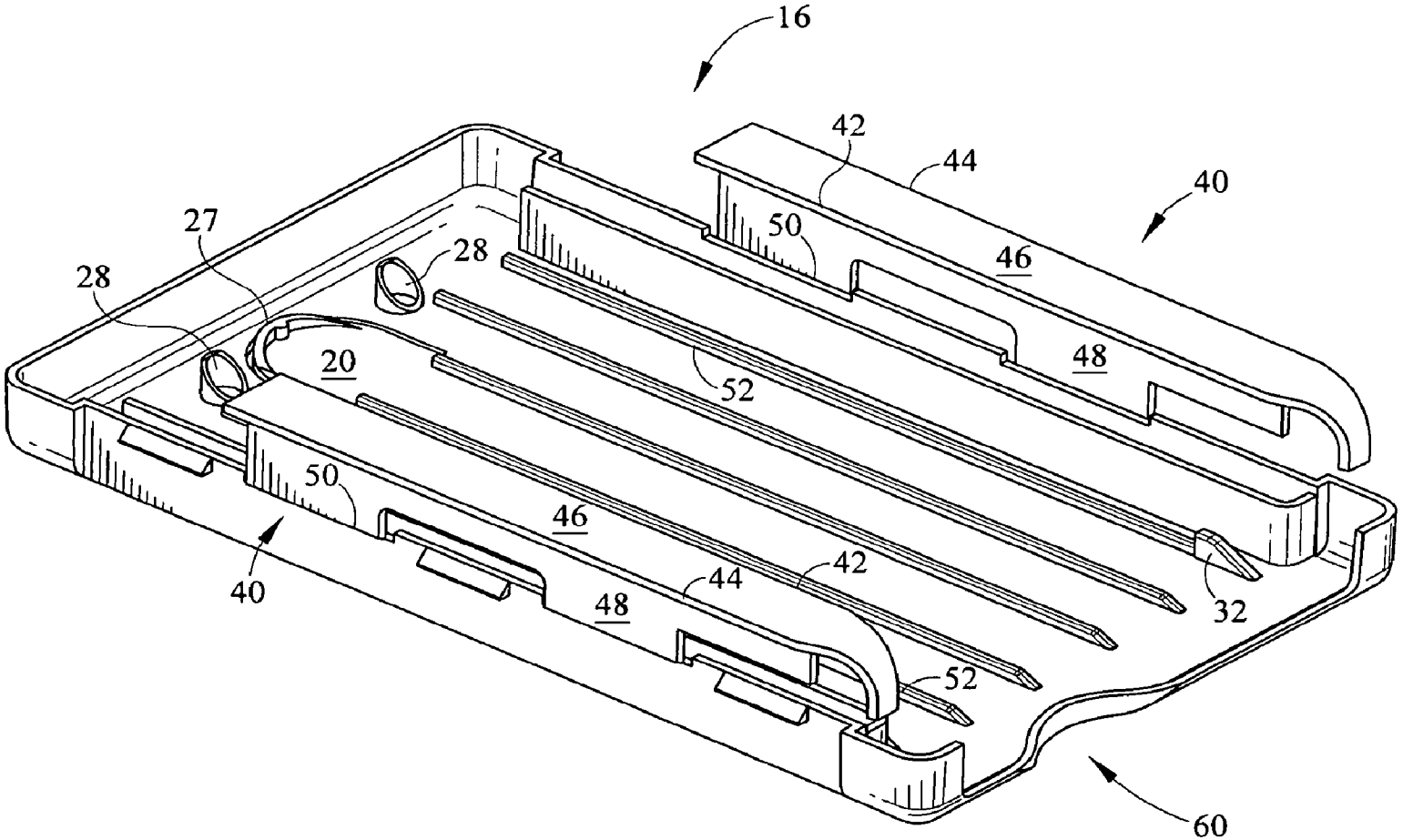
Figure 5:
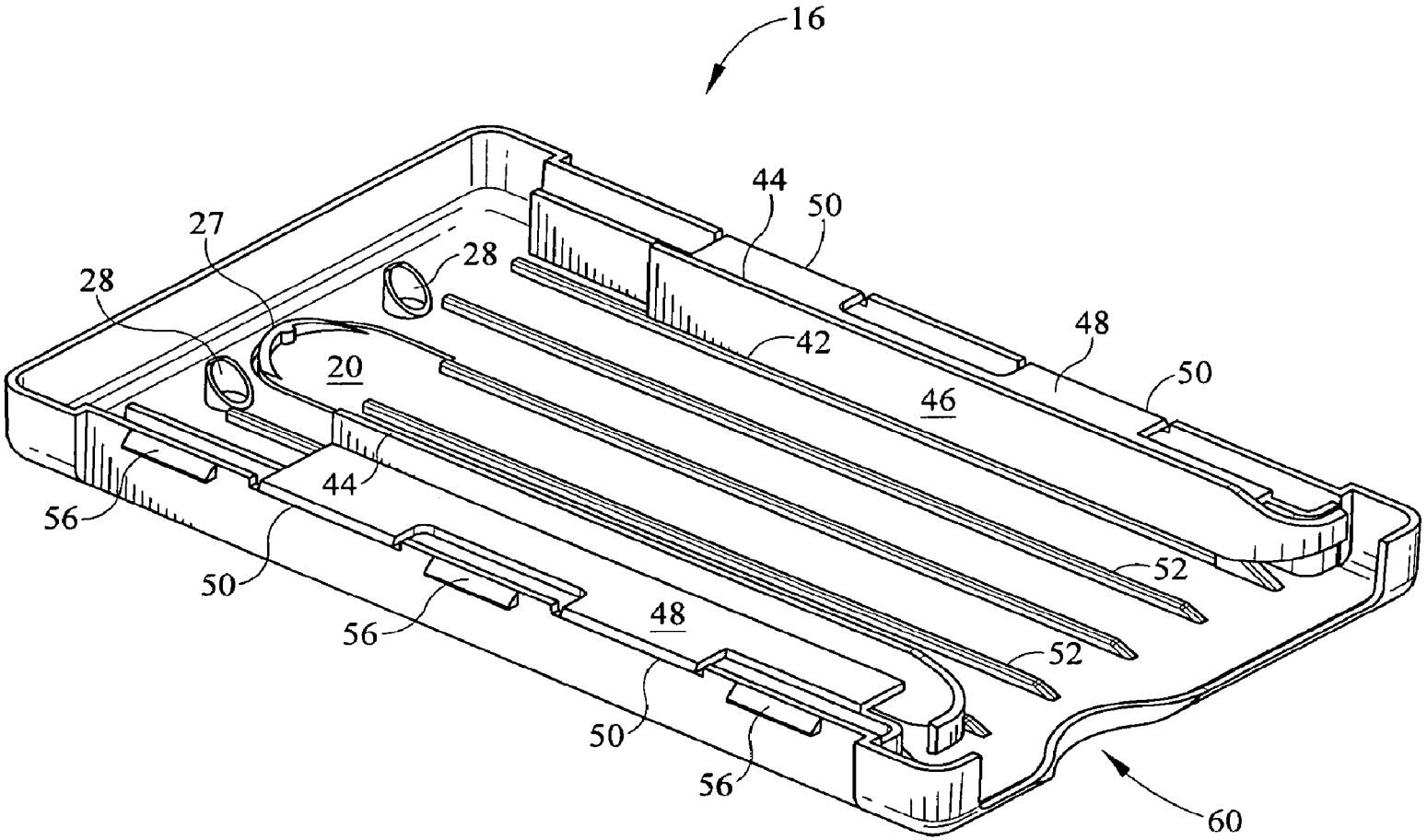

As best shown in FIGS. 3-5, each of the illustrated guide rails 40 includes a first retaining edge 42, a second retaining edge 44, and a guide face 46 that spans between the respective edges 42, 44. The illustrated embodiments show guide rails 40 hingedly attached to the base 16, but the guide rails 40 can be hingedly or fixedly attached to any portion of the sleeve 14, or formed integrally with the sleeve 14, or formed separately and later attached or otherwise associated with the sleeve 14. These guide rails 40 are hingedly attached to the base 16 by way of wing panels 48 that span between the back of the guide face 46 and a hinge 50.

Figure 9:
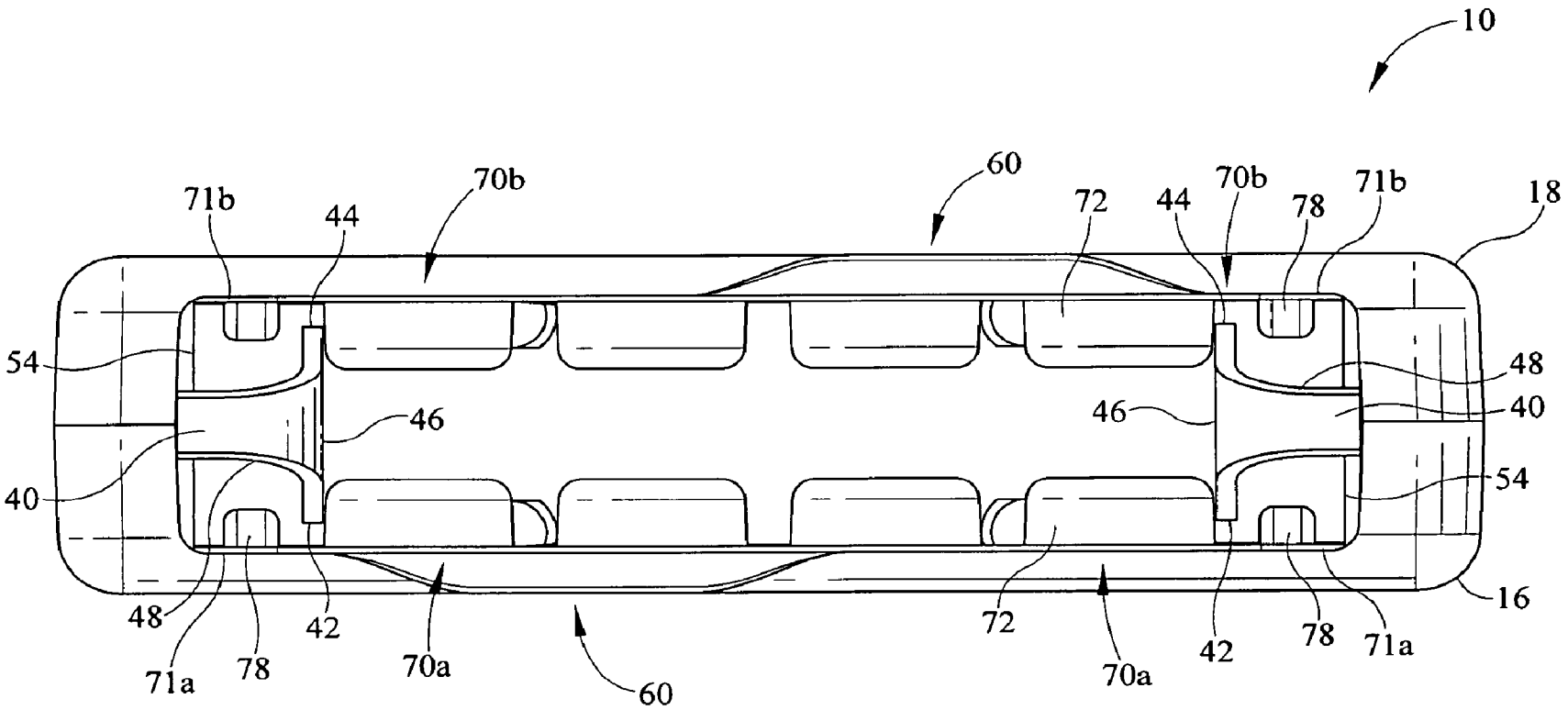
FIG. 9 is an end elevation view of the assembled package of FIG. 1.

Both the illustrated base 16 and top 18 include support ribs 52, and an optional interior side walls 54, best shown in FIG. 9, spaced apart from the respective outer side walls that form the sleeve 14. Associated with the base 16 are engaging tabs 56 and associated with the top 18 are engaging apertures 58 (best shown in FIGS. 1 and 2). Together, the engaging tabs 56 and engaging apertures form a means for attaching the base 16 to the top 18. In alternative embodiments these elements are reversed or other attachments are used such as a pins and cylinders. In addition, an optional recess 60 is provided for each of the base 16 and top 18 for easier access to the sliding element(s) 12.

Figure 6:
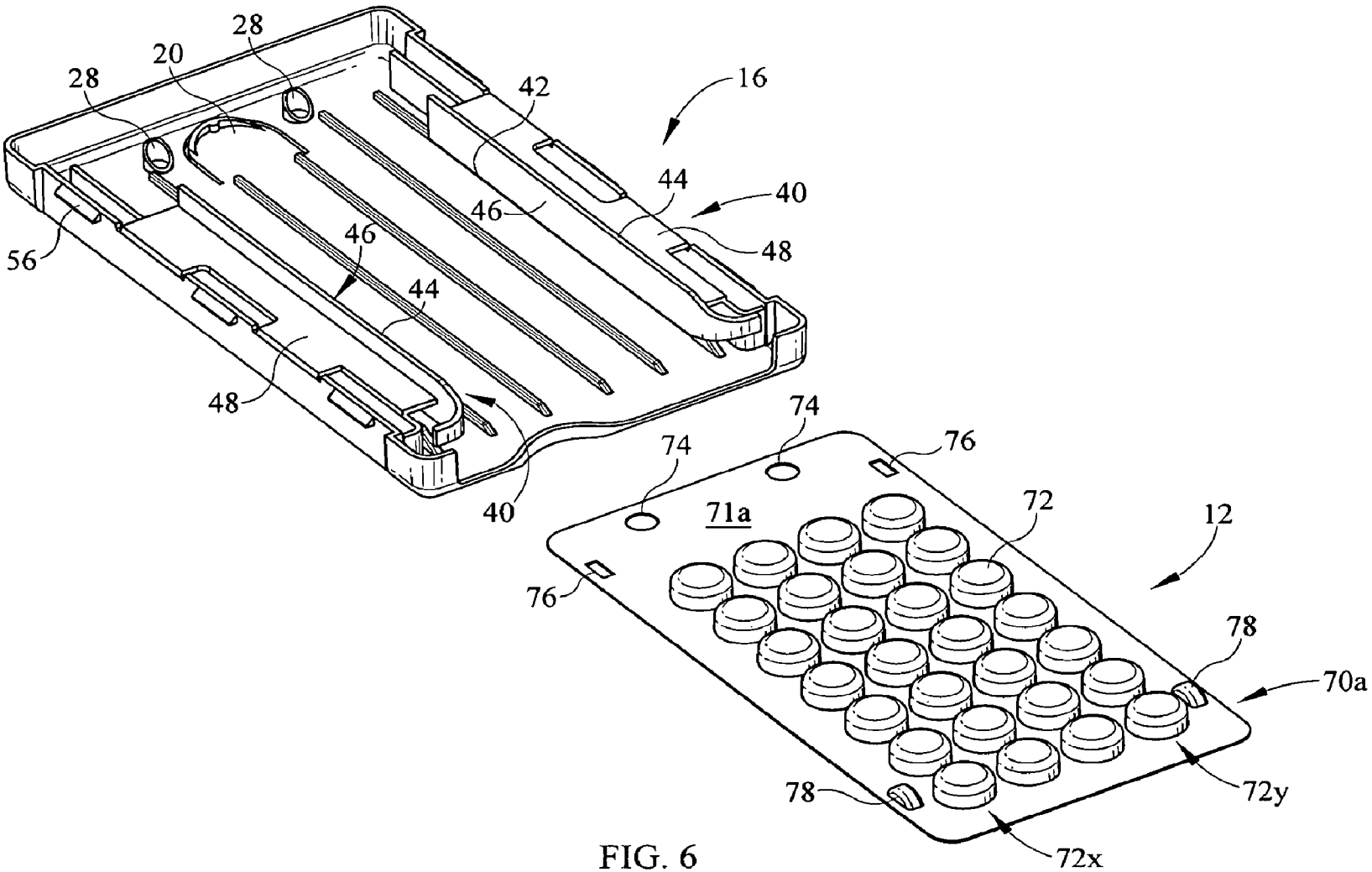
FIGS. 6-8 are perspective views showing the assembly of the package of FIG. 1.

Turning now to FIG. 6, the illustrated sliding element 12 is a blister pack 70*a* comprising a base 71*a*, at least one blister 72 configured to hold at least one article (not shown), at least one locking aperture 74, optional stop apertures 76, and optional stop catches 78. Here, for purposes of illustration and not limitation, the sliding element is a blister pack 70 and the means for holding articles are the blister 72. In alternative embodiments the sliding elements are trays, shelves, cards, racks, and the like that hold articles or primary containers such as chips, satchels, pouches, pillows, vials, blister packs, and the like. In alternative embodiments the means for holding includes compartments, racks, recesses, holds, ties, wraps, adhesives, and all manner of mechanical and/or chemical attachments, and the like, or combinations thereof.

The assembly and operation of the elements listed above to form a sleeve or container 14, or a package 10, will now be described with reference, primarily, to FIGS. 3-7. An exemplary method for assembling the sleeve 14 begins with reference to FIGS. 3-5. FIG. 3 shows a base 16 with the associated guide rails 40 splayed outwardly, as the illustrated base 16 may be configured shortly after manufacture. The guide rails 40 are rotated inwardly, that is, toward the interior of the base 16 as sequentially shown in FIG. 4 and then FIG. 5. Thereafter, the top 18 can be permanently or temporarily attached to the base 16, as best shown in FIG. 8, by matingly aligning each engaging tab 56 to each respective engaging aperture 58 until the respective elements engage to form a five-sided container that defines an interior void. Further, the sleeve 14 can be permanently welded, glued, or otherwise connected if so desired.

Figure 7:
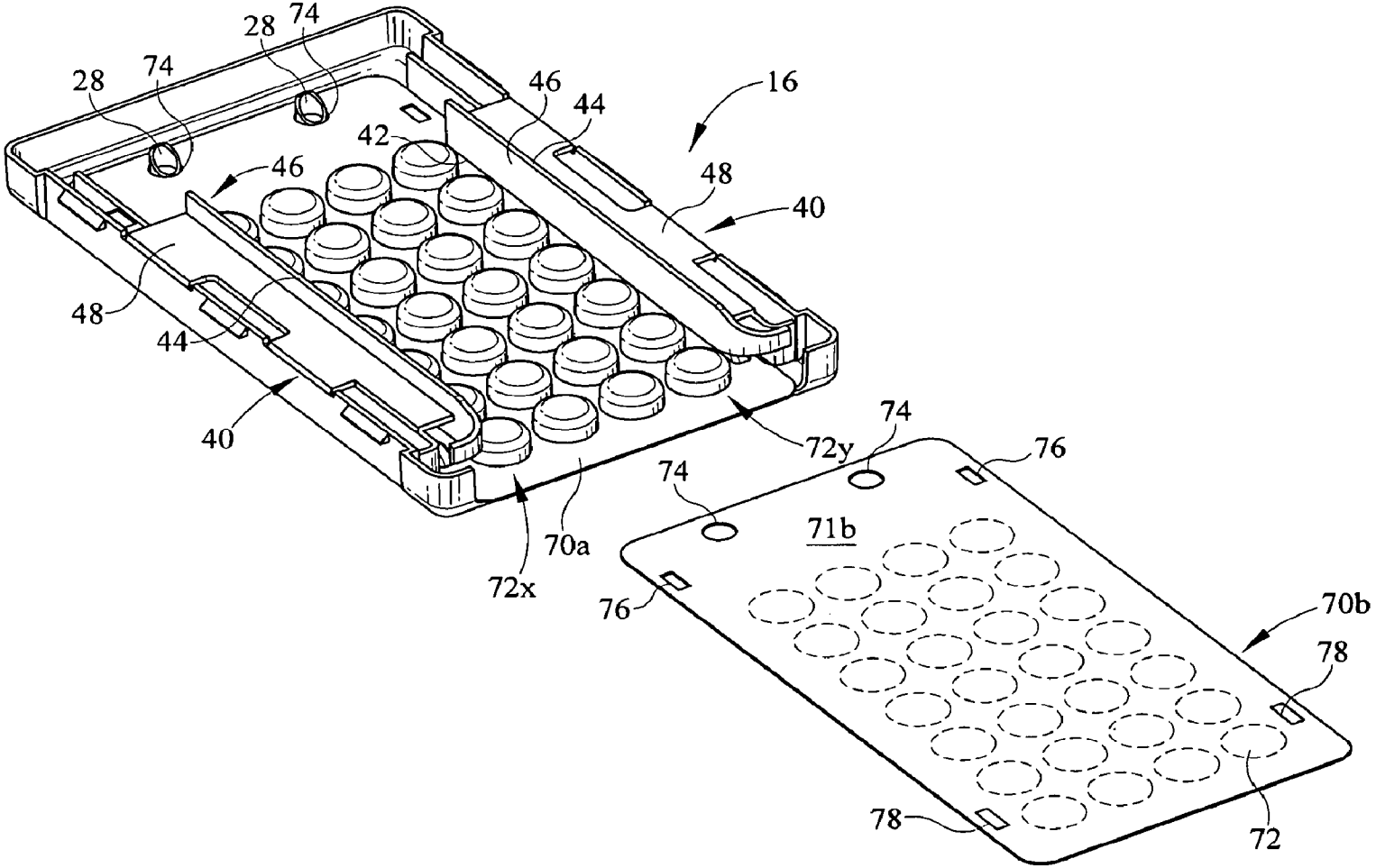

With reference now to FIGS. 6-8, the illustrated method shows a first and a second blister pack 70*a*, 70*b* being inserted into the sleeve 14. Please note that, in order to more clearly observe the loading of the sliding elements 12 into the sleeve 14, the sleeve 14 is shown without the top 18. Further, with regard to this illustrated embodiment, the loading of a first blister pack 70*a* into the base 16 is substantially identical to the loading of a second blister pack 70*b* into the top 18. Accordingly, only the loading of the first blister pack 70*a* will be described in detail.

As best shown in FIGS. 6 and 7, a sliding element 12 is inserted into an assembled sleeve 14 to form a lockable pack age 10. In inserting the sliding element 12, shown here as a first blister pack 70*a*, into the open end of the sleeve 14 the blister pack flange or base 71*a* is captured between each first retaining edge 42 and a support rib 52 or the adjacent interior surface of the base 16. This capturing of the flange 71*a* contributes to retaining and holding multiple sliding elements within the sleeve, and keeping respective sliding elements substantially separated from each other, as best illustrated in FIG. 9. Continuing with reference to FIGS. 6 and 7, further inserting the blister pack 70*a* allows the opposite sides of the first and last column of blisters 72*x*, 72*y* to contact the respective guide face 46, which laterally guides the blister pack 70*a* as it is translated between a fully inserted (closed or closed and locked) and fully extended (open) positions. In addition, the opposite sides of the blister pack base 70*a* are guided by the respective interior side walls 54.

Fully inserting the blister pack 70*a* into the sleeve 14 allows the locking apertures 74 to ride up and over the respective locking posts 28 until they breech and engage the locking apertures 74 along the respective engaging edge 30. Located at the opposite end of the blister card 70*a*, proximate to the open end of the sleeve 14, are optional stop catches 78 positioned over optional stop ribs 32. The engagement of the stop catches 78 and stop ribs 32 increases the withdrawal resistance of the blister pack 70*a*. With the locking tabs 28 and locking apertures 74 engaged the sliding element 12 is now fully inserted and releaseably locked within the sleeve 14.

To release a locked sliding element 12 from the protective sleeve 14, the release button 20 is pressed inwardly, to lift each locking aperture 74 until the locking aperture(s) 74 is lifted over the respective locking post(s) 28. Simultaneously, the opposite or free end of the sliding blister pack 70*a* is grasped at the recess 60 and pulled to reveal at least a first blister 72 holding an article. The illustrated blister pack 70*a* can continue to be extracted from the sleeve 14, but may be stopped from being fully extracted when the optional stop ribs 32 engaged the respective optional stop apertures 76.

Some alternative embodiments do not include the releaseable locking mechanism elements 20, 28, 74 as regards one or more sliding elements. Further, in some embodiments one sliding element is locked while another is not, while in other embodiments both sliding elements are locked, while in still other embodiments neither sliding elements are locked. Additional combinations including additional sliding elements are contemplated.

Figure 10:
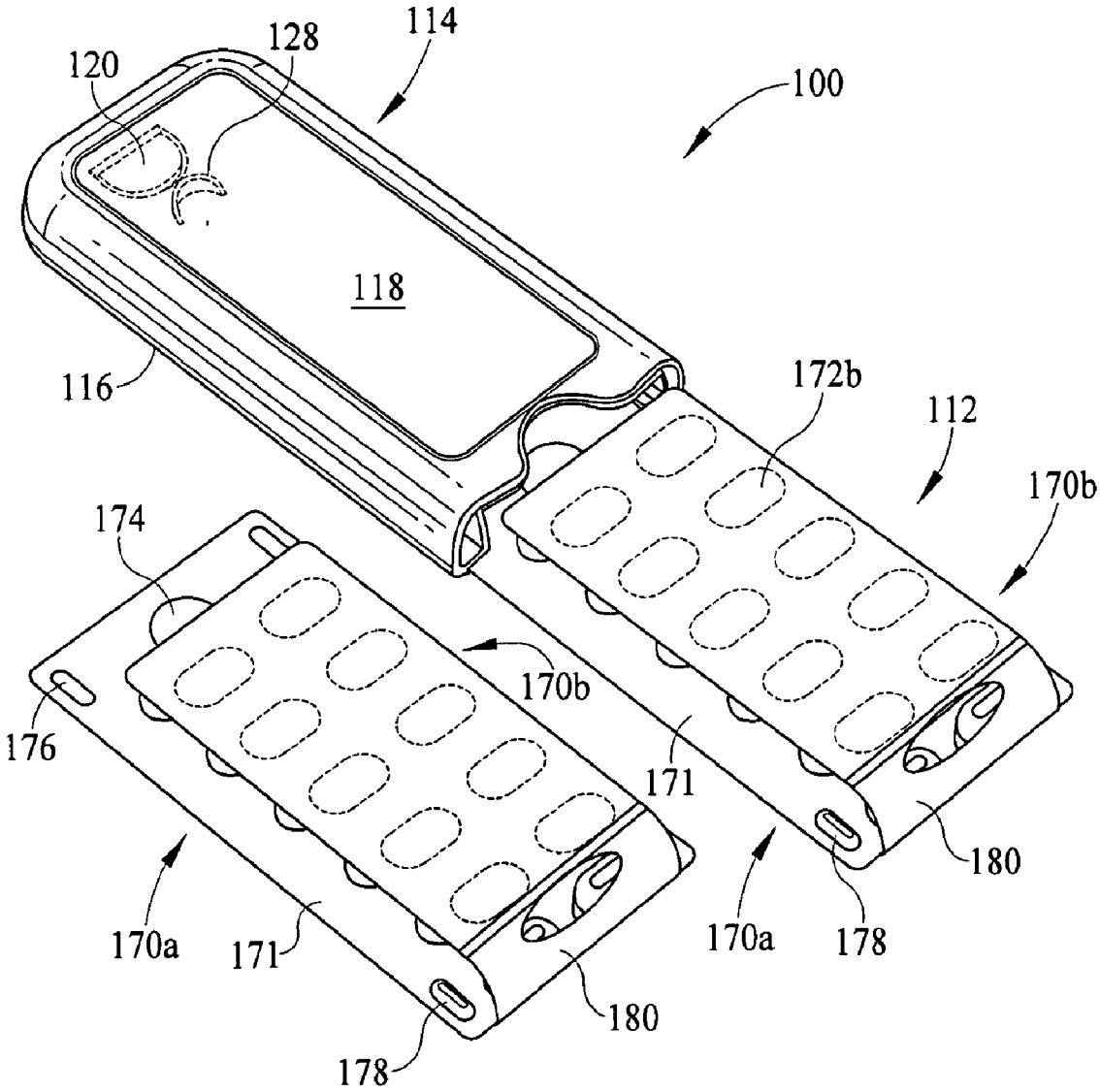
FIGS. 10-11 show an alternative embodiment of the package of FIG. 1, according to the present disclosure.
Figure 11:
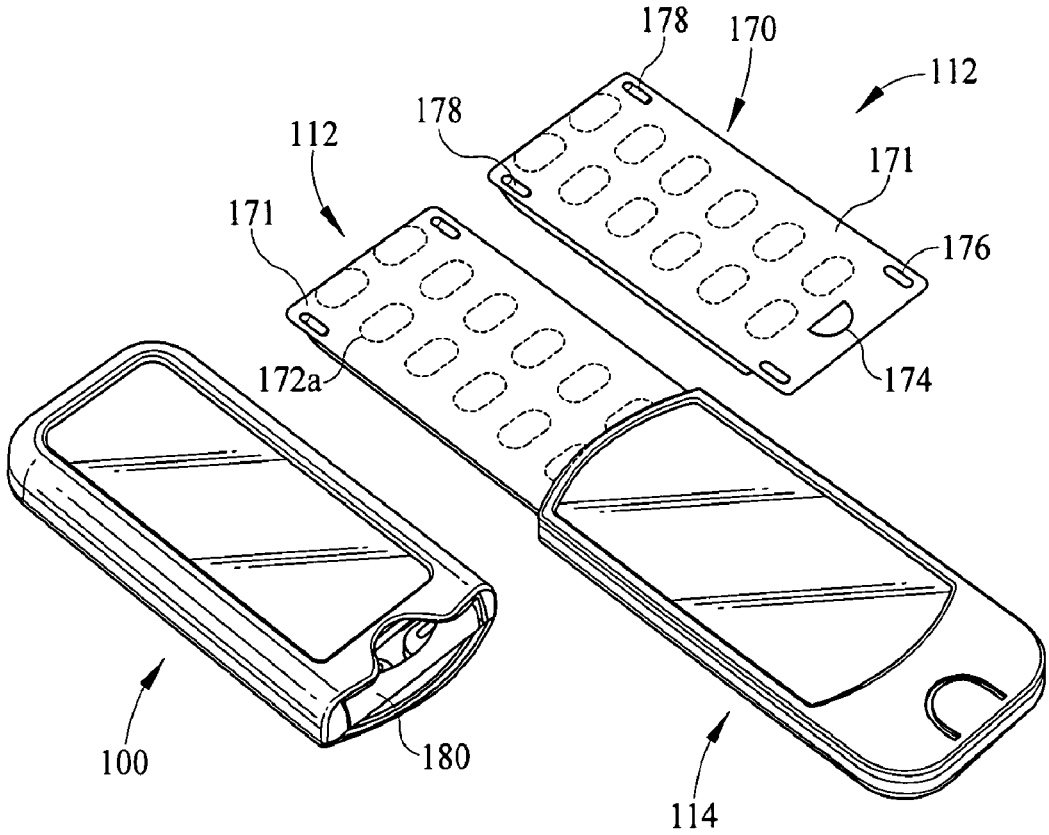

An alternative embodiment of the present disclosure is illustrated in FIGS. 10 and 11. Many substantially similar or equivalent elements illustrated and discussed above are present in this alternative embodiment. These elements are designated with the prefix number "1" to signal a different embodiment but a substantially similar equivalent or element. For example, the sliding element 112 of FIG. 10 is equivalent to the sliding element 12 in FIG. 1 as the element numbers are identical except for the prefix number "1"; contrast that to the element number 180 in FIG. 10, which is new as no previous element was designated with the number "80".

The illustrated sleeve 114 includes only a single locking post 128 and a single release button 120. The illustrated sliding element 112 includes only a single locking aperture 174 but introduces a hinge 180, which connects multiple sliding elements 170*a*, 170*b* previously illustrated as separate sliding elements 70*a*, 70*b*. Note that the illustrated upper sliding element 170*b* is narrower than the lower sliding element 170*a*. This configuration allows for the upper blisters 172*b* to rest on or between the lower blisters 172*a*, and for guide rails 140 (not shown) with a guide face 146 but only a first retaining edge 142 (not shown). With this combination of alternative elements the illustrated package 110 may provide at least the same increased capacity as the embodiment illustrated above. In operation the release button 120 is pressed to disengage the attached locking elements 128, 174 and allow the user to extend the sliding element 112 from the sleeve 114. Thereafter, the upper blister pack 170*b* may be unfolded to access the articles held on either the lower or upper blister packs 170*a*, 170*b*.

Figure 12:
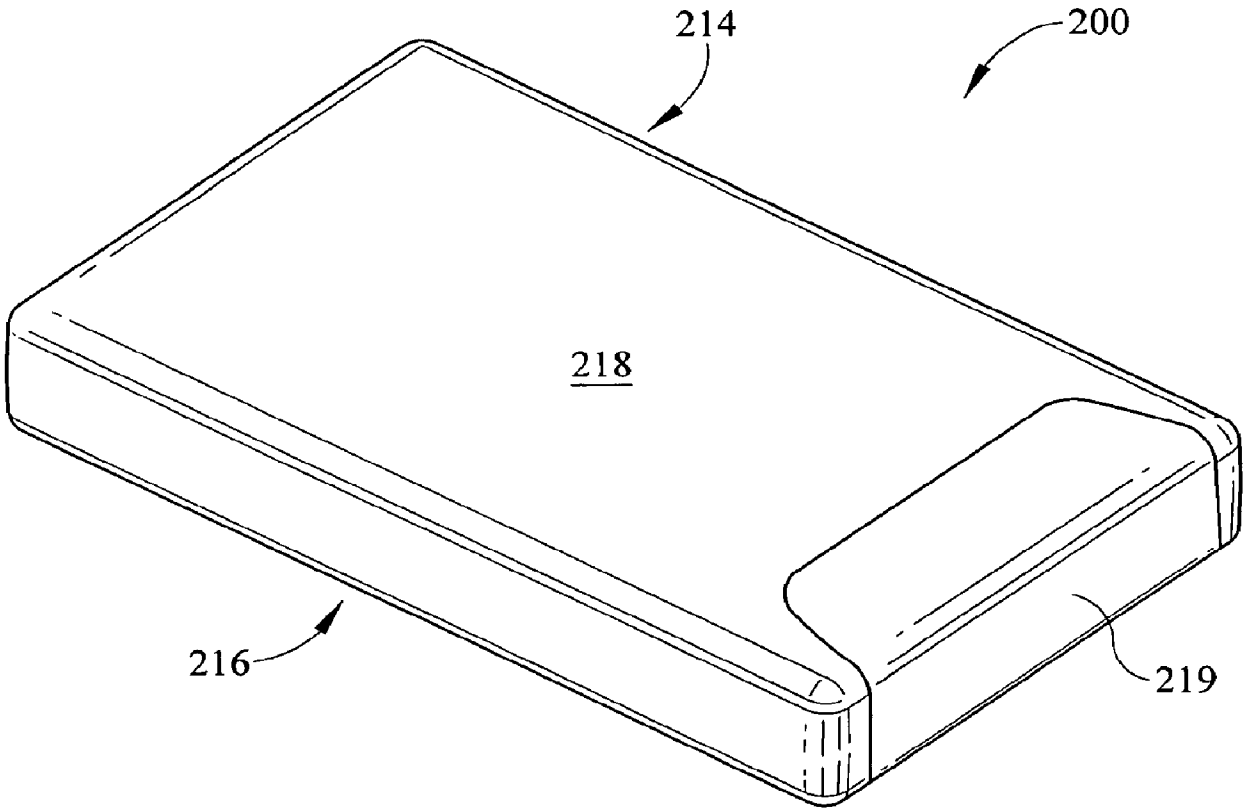
FIGS. 12-13 show a second alternative embodiment of the package of FIG. 1, according to the present disclosure.
Figure 13:
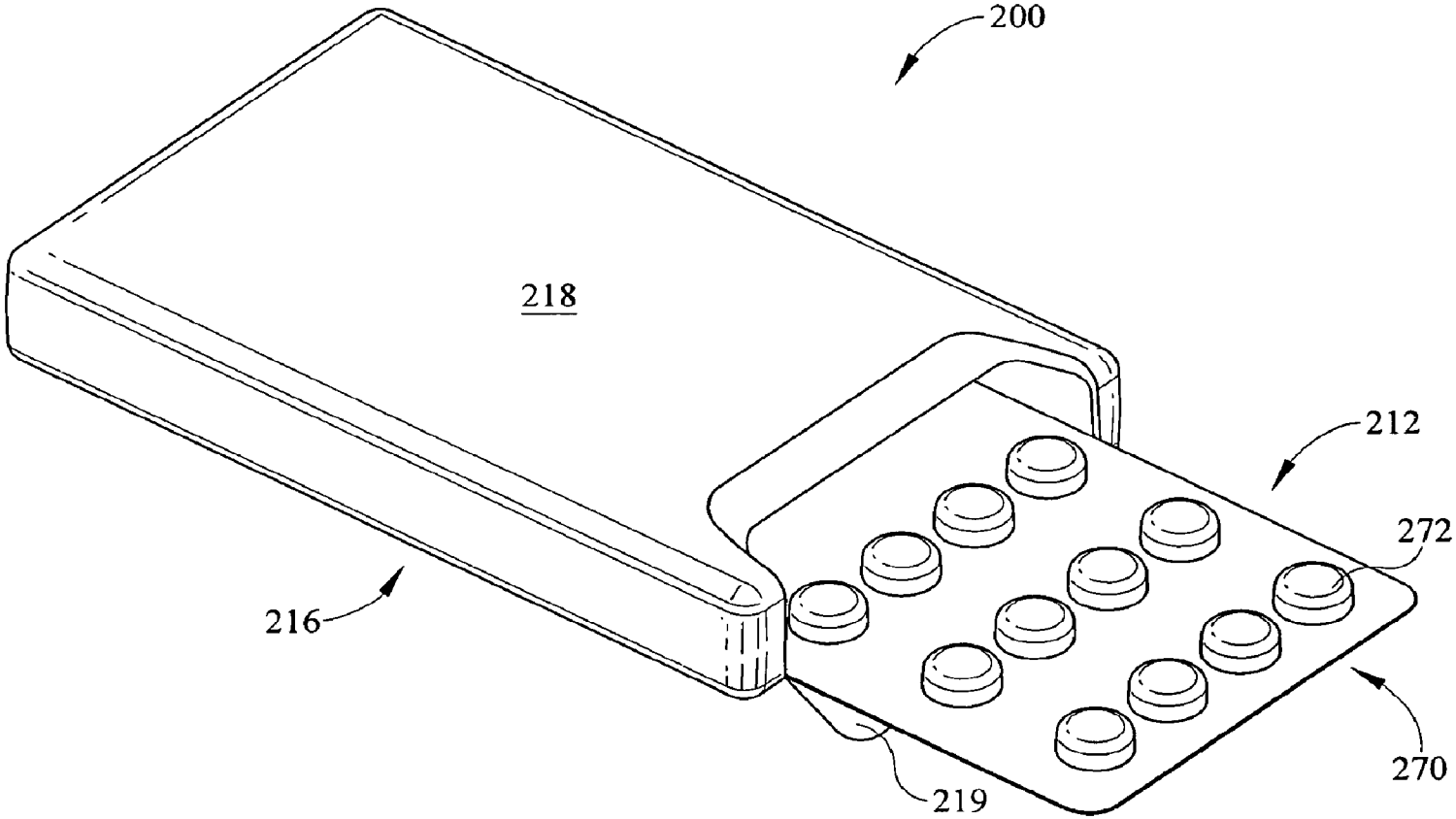

An alternative embodiment of the present disclosure is illustrated in FIGS. 12 and 13. Many substantially similar or equivalent elements illustrated and discussed above are present in this alternative embodiment. These elements are designated with the prefix number "2" to signal a different embodiment but a substantially similar element. For example, the sliding element 212 of FIG. 13 is equivalent to the sliding element 12 in FIG. 1 as the element numbers are identical except for the prefix number "2"; contrast that to the element number 219 in FIG. 12, which is new as no previous element was designated with the number "19".

The previous illustrated packages 10, 110 included a locking mechanism comprising a locking post(s), release button(s), and engaging aperture(s). These combinations of elements illustrate a child-resistance feature. Alternative embodiments do not include these child-resistance features. To that end, those embodiments are packages that receive and hold multiple sliding elements, or the equivalent, but wherein the sliding element is not necessarily locked in the sleeve. Alternatively, as shown in FIGS. 12 and 13, a package that hold multiple sliding elements may include a removable top 219, that may or may not require coordinated motions to open such that it provides a level of child-resistance For the purposes of teaching and not limitation, various elements are described herein with directional or positional adjectives, such as "top", "base", "lower", "first", "second", and "upper", but it is contemplated that the position or location of many elements can be switched or reversed. The respective locations of certain features including the locking mechanism components 74, 28, 20 and the optional engaging and stopping elements 32, 76, 78 are design choices.

The law does not require and it is economically prohibitive to illustrate and teach every possible embodiment of the present claims. Hence, the above-described embodiments are merely exemplary illustrations of implementations set forth for a clear understanding of the principles of the disclosure. Variations, modifications, and combinations may be made to the above-described embodiments without departing from the scope of the claims. All such variations, modifications, and combinations are included herein by the scope of this disclosure and the following claims

What is claimed:

1. A storing and dispensing system, comprising:

a first sliding element comprising a base configured to hold at least one article, the base including a first flange portion;

a second sliding element comprising a base configured to hold at least one article, the base including a second flange portion;

a sleeve comprising:

a first side matingly connected to a second side to form a void for receiving the sliding elements;

an open end configured to permit the sliding elements to translate between a first position and a second position;

at least one guide rail including a first retaining edge and a second retaining edge, the guide rail positioned within the void, wherein the first flange portion is positioned between the first retaining edge and one of the first or second sleeve sides, and the second flange portion is positioned between the second retaining edge and the other of the first or second sleeve sides, wherein the first sliding element comprises a first locking element, and wherein the sleeve comprises a first locking element configured to releaseably engage the sliding first locking element.

2. The system of claim 1, wherein the first sliding element comprises a first stop element.

3. The system of claim 1, wherein the sleeve further comprises a release mechanism for disengaging the sleeve and sliding first locking elements.

4. The system of claim 2, wherein the sleeve further comprises a first stop element configured to matingly engage the sliding first stop element.

5. The system of claim 1, wherein the sleeve further comprises at least one interior side wall located within the void, and spaced apart from an exterior side wall.

6. The system of claim 1, wherein the at least one guide rail comprises a guide face.

7. The system of claim 6, wherein the guide face spans between the first and second retaining edges.

8. The system of claim 1, further comprising a cover configured to substantially close the open end.

9. The system of claim 1, wherein the first flange is captured between the first retaining edge and the first side, and the second flange is captured between the second retaining edge and the second side.

10. The system of claim 1, wherein the first retaining edge is separated from the first side by a first gap, the second retaining edge is separated from the second side by a second gap, the first flange portion is positioned in the first gap, and the second flange portion is positioned in the second gap.

* * * * *